US006609519B2

(12) United States Patent
Pietrelli

(10) Patent No.: US 6,609,519 B2
(45) Date of Patent: Aug. 26, 2003

(54) DISTRIBUTOR FOR UNDERWATER BREATHING APPARATUS

(75) Inventor: Nino Pietrelli, Sori (IT)

(73) Assignee: HTM Sport S.p.A. (IT)

( * ) Notice: Subject to any disclaimer, the term of this patent is extended or adjusted under 35 U.S.C. 154(b) by 296 days.

(21) Appl. No.: 09/768,237

(22) Filed: Jan. 25, 2001

(65) Prior Publication Data

US 2002/0020413 A1 Feb. 21, 2002

(30) Foreign Application Priority Data

Aug. 18, 2000 (IT) ..... GE2000030 U

(51) Int. Cl.[7] ..... F16K 31/26

(52) U.S. Cl. ..... 128/204.26; 128/205.24; 128/204.18

(58) Field of Search ..... 128/200.24, 201.27, 128/204.18, 204.26, 205.22, 205.24, 205.25, 206.21, 206.28, 207.12, 207.14–207.18

(56) References Cited

U.S. PATENT DOCUMENTS 3,991,785 A * 11/1976 Trinkwalder ..... 137/494
4,002,166 A 1/1977 Oliver
4,214,580 A 7/1980 Pedersen
4,616,645 A 10/1986 Pedersen et al.
5,549,107 A * 8/1996 Garraffe et al. ..... 128/204.26
5,803,073 A * 9/1998 Toth ..... 128/205.24
5,970,977 A 10/1999 Sattelberg
6,089,225 A * 7/2000 Brown et al. ..... 128/200.29
6,354,291 B1 * 3/2002 Brown et al. ..... 128/200.29

FOREIGN PATENT DOCUMENTS

EP 0 937 640 A1 8/1999
FR 2 308 546 11/1976

* cited by examiner

*Primary Examiner*—Glenn K. Dawson
(74) *Attorney, Agent, or Firm*—Larson & Taylor, PLC

(57) ABSTRACT

Distributor for underwater breathing apparatus, including: a box-shaped body housing a device for regulating the air flow coming from a source of pressurized air; a tube connected to said box-shaped body and communicating with a mouthpiece; an air intake duct connected to said box-shaped body by an intake valve; and one or more discharge ducts connected to said box-shaped body. The air intake duct includes a structure which induces rotation of the air flow coming from the source of pressurized air, thus reducing its intake speed into the tube connected to the mouthpiece.

4 Claims, 1 Drawing Sheet

DISTRIBUTOR FOR UNDERWATER BREATHING APPARATUS

BACKGROUND AND SUMMARY OF THE INVENTION

The present invention relates to distributors for underwater breathing apparatus.

As is known, distributors for underwater breathing apparatus comprise a box-shaped body housing a device for regulating the air jet coming from an intake duct connected by means of a suitable valve to a source of compressed air, such as diving bottles, and being sent to a mouthpiece. Said air jet coming from the intake duct goes through a chamber provided in the regulation device and communicating with the mouthpiece or, in case of a distributor provided with a by-pass tube of said chamber, it goes through said by-pass and reaches directly said mouthpiece.

In both types of distributors, with or without a by-pass, some problems may occur linked with forced injection of air into the mouthpiece and therefore into the diver's mouth, in the form of a violent air jet coming from the intake duct or from the by-pass duct, and sometimes the phenomenon of auto-distribution may occur. Said phenomenon obviously influences the diver's breathing and makes it forced and often problematic.

The aim of the present invention is to overcome the disadvantages resulting from the above-mentioned phenomenon, therefore providing a distributor giving the user a feeling of natural non forced breathing when it is used, thus eliminating the "injection" phenomenon.

Said aim is achieved by the present invention by means of a distributor for underwater breathing apparatus, comprising a box-shaped body housing a device for regulating the air flow coming from a source of pressurized air; a tube connected to said box-shaped body and communicating with a mouthpiece; an air intake duct connected to said box-shaped body by means of an intake valve; and one or more discharge ducts connected to said box-shaped body. Within said distributor, in the air intake duct, means are arranged which induce a rotation in the air flow coming from the source of pressurized air, thus reducing the intake speed into the tube connected to the mouthpiece.

BRIEF DESCRIPTION OF THE DRAWINGS

The following description will refer as a mere non limiting example to a distributor provided with a by-pass known from U.S. Pat. No. 6,279,575 belonging to the owners of the present application. Said description will point out further aims and advantages of the present invention and will refer to the only enclosed drawing, in which.

DESCRIPTION OF THE PREFERRED EMBODIMENT OF THE INVENTION

Figure 1:
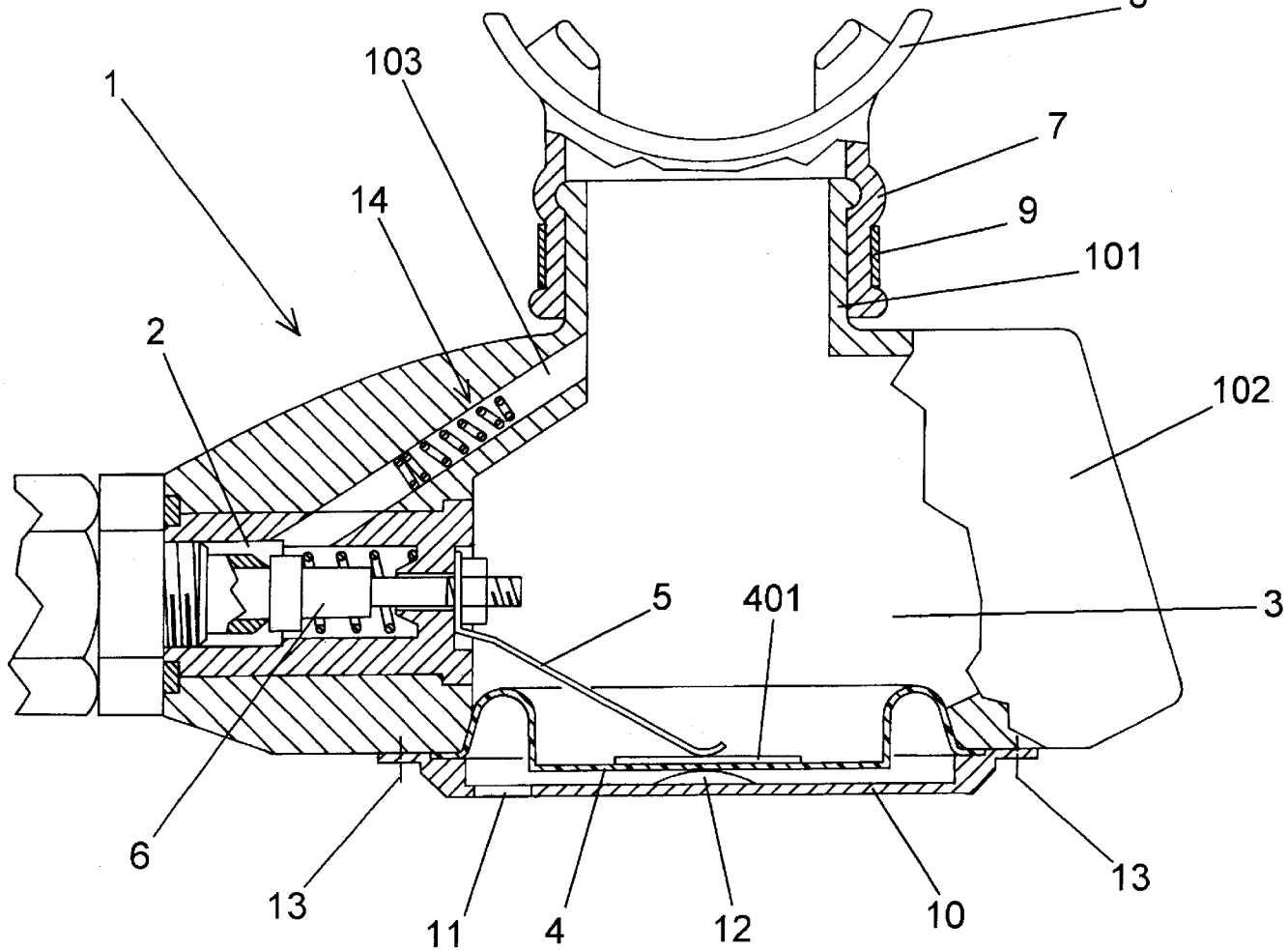
FIG. 1 shows a top view partially sectioned of a distributor for underwater breathing apparatus according to the present invention.

FIG. 1 shows a distributor for underwater breathing apparatus comprising a box-shaped body 1 housing a device (3, 4, 5, 6) for regulating the air flow coming from an intake duct 2. Said regulation device substantially comprises a chamber 3 having a flexible membrane 4 on the end of said box-shaped body 1 opposed to a mouthpiece 8; said flexible membrane 4, due to the pressure differential resulting when the scuba-diver inhales, operates the lever 5 coupled in a known way with the valve 6 for regulating the air flow, so that said valve 6 opens the intake duct 2. The box-shaped body 1 further comprises an integral tube 101 coupling with a connection 7 of the mouthpiece 8, said connection 7 being advantageously made of an elastomeric material and provided with a sealing ring 9 for the distributor. The box-shaped body 1 further comprises a discharge duct 102, placed laterally with respect to the diver's mouthpiece 8, and a by-pass tube 103 obtained integrally within the box-shaped body 1, for instance by molding of the plastic material constituting said box-shaped body. As can be seen from the FIGURE, the tube 103 takes air downstream from the regulation valve 6 and sends it directly to the tube 101 of the mouthpiece 8, thus by-passing the chamber 3 and creating within said chamber a depression which makes it easier for the stiff portion 401 of the flexible membrane 4 to act upon the lever 5. The distributor further comprises a stiff cap 10 on the flexible membrane 4. Said cap 10 is provided with an opening 11 for the communication of said membrane 4 with the surrounding water, so as to create between the surfaces of the latter the pressure differential which is necessary for the working of the regulation device. In this embodiment said cap 10 is fixed by means of pins 13 to the box-shaped body 1, and the flexible membrane 4 being introduced on its ends between the box-shaped body 1 and the cap 10 ensures an efficient sealing of the breathing apparatus. There is also, in a know way, a button 12 as bleeder and as distributor control. According to the present invention a spiral 14 having the shape of a frustum of cone is introduced into the by-pass tube 103, said spiral being fitted into said tube and having the function to reduce the speed of the air jet coming from the intake duct 2. Said speed reduction is due to the reduction of the kinetic energy of the air jet induced to rotation, which therefore does not reach the mouthpiece as a high speed direct air jet, thus giving the user the feeling of breathing more naturally and eliminating the phenomenon of forced injection onto the diver's mouth.

Obviously, the effect of rotation induction and the reduction of air speed can be controlled by varying the distance, the shape and the number of spires in the spiral 14, which, instead of the embodiment in FIG. 1, can also be carried out with a cylindrical section.

Moreover, if the distributor is not provided with by-pass, the spiral, be it in the shape of a frustum of cone or cylinder, can be introduced directly onto the intake duct 2 upstream from the valve 6, thus obtaining the same advantageous effects onto the air jet as previously described.

I claim:

1. A distributor for underwater breathing apparatus, comprising:

a box-shaped body housing a device for regulating the air flow coming from a source of pressurized air; a tube connected to said box-shaped body and communicating with a mouthpiece; an air intake duct connected to said box-shaped body by an intake valve; and one or more discharge ducts connected to said box-shaped body, wherein said air intake duct includes a spiral placed within said intake duct to induce rotation in the air flow coming from the source of pressurized air, thus reducing its intake speed into the tube connected to the mouthpiece.

2. A distributor according to claim 1, in which said spiral has a section in the shape of a frustum of cone.

3. A distributor according to claim 1, in which said spiral has a cylindrical section.

4. A distributor for underwater breathing apparatus, comprising:

a box-shaped body housing a device for regulating the air flow coming from a source of pressurized air; a tube connected to said box-shaped body and communicating with a mouthpiece; an air intake duct connected to said box-shaped body by an intake valve; and one or more discharge ducts connected to said box-shaped body, wherein said air intake duct includes means for inducing rotation in the air flow coming from the source of pressurized air, thus reducing its intake speed into the tube connected to the mouthpiece, and further comprising a bypass tube directly connecting the air intake duct to the tube in communication with the mouthpiece, said means for inducing rotation located in the bypass tube.

* * * * *